United States Patent [19]

Emerson et al.

[11] Patent Number: 4,892,039

[45] Date of Patent: Jan. 9, 1990

[54] RING DETONATOR FOR SHAPED-CHARGE WARHEADS

[75] Inventors: John D. Emerson, Arab; Scott D. Hill, Toney, both of Ala.

[73] Assignee: The United States of America as represented by the Secretary of the Army, Washington, D.C.

[21] Appl. No.: 321,688

[22] Filed: Mar. 9, 1989

[51] Int. Cl.[4] ..... F42B 11/22

[52] U.S. Cl. ..... 102/476; 102/306

[58] Field of Search ..... 102/305, 306, 309, 475, 102/476, 701

[56] References Cited

U.S. PATENT DOCUMENTS

| | | | |
|---|---|---|---|
| 3,027,838 | 4/1962 | Meddick | 102/306 |
| 3,100,445 | 8/1963 | Poulter | 102/306 |
| 3,561,361 | 2/1971 | Kessenich et al. | 102/306 |
| 3,736,875 | 6/1973 | Bucklishch | 102/306 |
| 4,250,792 | 2/1981 | Deigmuller et al. | 102/476 |

*Primary Examiner*—Charles T. Jordan

*Attorney, Agent, or Firm*—Freddie M. Bush; James T. Deaton

[57] ABSTRACT

A ring detonator device for a warhead transfers a point initiation to the ring detonator. The detonator device is comprised of an inner and outer conically shaped member with the outer conically shaped member having the shape of a modified frustum of a circular cone due to a cylindrical member extending from the smaller base of the outer conically shaped member. The space between the inner and outer conically shaped member contains an explosive composition which is discharged as a shock wave and detonation products after ignition in a ring configuration by a common cylindrical portion extending from each of the larger bases of each conically shaped member to align the space therebetween perpendicular to the bases of the conically shaped members. The ring detonator results in a flatter wave front per unit length of warhead thereby achieving improved efficiency and the use of a shorter warhead.

2 Claims, 2 Drawing Sheets

RING DETONATOR FOR SHAPED-CHARGE WARHEADS

DEDICATORY CLAUSE

The invention described herein may be manufactured, used, and licensed by or for the Government for governmental purposes without the payment to us of any royalties thereon.

BACKGROUND OF THE INVENTION

The waveshaper for a warhead has been traditionally made during the production procedure. Examples of ring shaped detonators which are used for two types of warhead include a 120 millimeter HEAT round for tanks which employs a soft plastic waveshaper and the MILAN anti tank missile employing similar technology. Both of these technologies for manufacturing require that the ring initiator be in place during warhead fabrication. Alignment must be checked in both cases with an X-ray of the warhead. Adjustment is not possible once the warhead is fabricated.

Other detonators which are used in the standard method of initiating an explosive charge are by centering the detonator at the rear of the warhead. The formation of a shaped-charge penetrator is dependent upon the shock wave collapsing of the typical copper, cone-shaped liner of the warhead. It has been determined that an optimal formation of the standard 42 degree copper cone occurs when the shock front resembles a flat plane wave. When a single point initiator is used, it generates a shock front in the form of a spherical wave front. As the wave front moves through the explosive, the radius of curvature increases and the wave front begins to resemble a plane wave.

The advantage of a point detonation when transitioned to the periphery of a combination device would offer several advantages in its field of use.

Therefore, an object of this invention is to provide a ring detonator device which allows a point initiation to be transferred to a ring detonator.

A further object of this invention is to provide a detonator device wherein the diameter of the detonator relative to the diameter of the warhead allows the formation of a wave front of a flat plane in a shorter distance.

SUMMARY OF THE INVENTION

A ring detonator device is provided which allows a point initiation to be transferred to the ring detonator. The detonator device is comprised of an inner and outer conically shaped member with the outer conically shaped member having the shape of a modified frustum of a circular cone because of a cylindrical member extending from the smaller base of the outer conically shaped member. The inner conically shaped member is mated with the outer modified frustum of a circular cone shaped member to define a space therebetween for containing an explosive composition. The inner and outer conically shaped members have a cylindrical portion extending from each of the larger based of each conically shaped member to align the defined space therebetween perpendicular to the bases of the conically shaped members to thereby discharge from the ring of the ring detonator the detonation shock wave and detonation products from the explosive composition after ignition. The cylindrical member extending from the smaller base of the outer conically shaped member has an opening extending therethrough to a defined space for containing an explosive composition which serves as a single point initiator. A plurality of threaded inserts extend through the slant height sections of the inner and outer member for securing them in a spaced apart relationship which defines the space therebetween for containing the explosive composition. An igniter for the 10 single point initiator serves to transition a point source initiation to the periphery of the ring detonator. This device has a predetermined diameter of the inner conically shaped member that is about two thirds the diameter of the warhead. The slant angle of the conical surfaces has a predetermined slope and height to achieve the desired diameter at the periphery of the larger base of the conical members within the given height or length constraints. The overall design generates a flatter wave front thereby permitting a shorter warhead and a better warhead performance for a same size warhead as compared to conventional warhead employing only a single point initiation.

DESCRIPTION OF THE PREFERRED EMBODIMENT

The detonator device of this invention is in the form of a ring detonator which allows a point initiation to be transferred to a ring. The device is made of aluminum, aluminum alloy, or other suitable material compatible with an explosive composition and an igniter composition.

Figure 1:
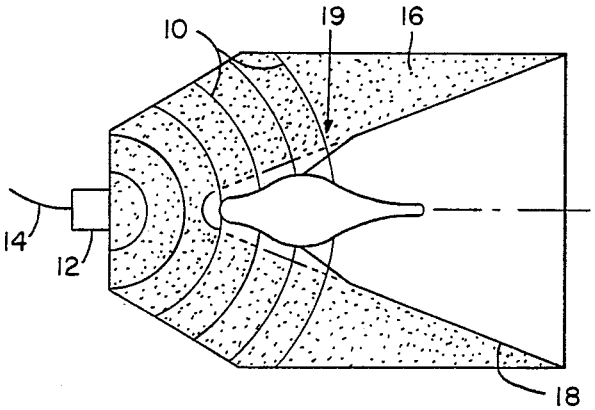
FIG. 1 (PRIOR ART)
FIG. 1 illustrates the development of a shock wave and simulates collapsing of the copper liner and the formation of a shaped-charge penetrator by a prior art method.

With further reference to the Figures of the drawing, FIG. 1 depicts a prior art method for the formation of a shaped-charge penetrator 19 which is dependent upon shock wave propagation 10 resulting from igniting a detonator charge 12 by igniter means 14. An explosive charge 16 is acted upon by the shock wave front as it moves through the explosive shape charge 16 to cause an increase in the radius $ of curvature as it gradually resembles a plane wave to achieve the collapsing of the copper metal liner 18 for shape charge 16. The shape-charge penetrator 19 (which represents a concentration of energy in the form of a jet centered along the center of the cone of the shape charge) is dependent upon the shock wave collapsing the copper liner of the warhead after the shock wave travels a predetermined distance to resemble a flat plane wave.

Figure 2:
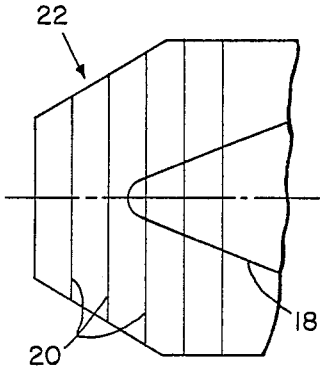
FIG. 2 illustrates a shock wave front represented as a plane wave for optimal formation of the standard 42 degree copper cone.

FIG. 2 illustrates that the optimal formation of the standard 42 degree copper cone occurs when the shock front resembles a flat plane wave (represented as 20) as it traverses warhead 22.

Figure 3:
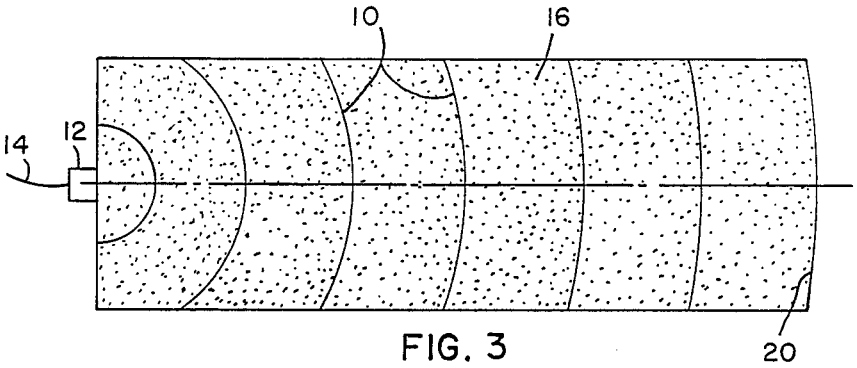
FIG. 3 illustrates a spherical wave front as it moves through an explosive to resemble a plane wave as the radius of curvature increases.

FIG. 3 illustrates that the shock wave generated by a single point initiator is a spherical wave front 10 as it travels through explosive 16 but after the spherical wave front travels a distance it resembles a plane wave 20.

Figure 4:
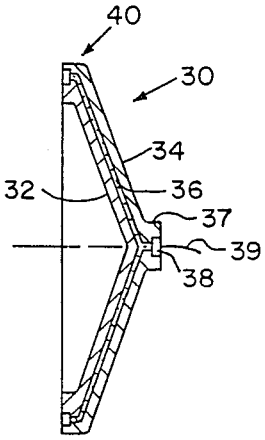
FIG. 4 is a sectional view of the ring detonator of the invention taken along line 4—4 of FIG. 5.

FIG. 4 illustrates the ring detonator 30 of this invention in a sectional view which illustrates inner conical shaped member 32 and outer conical shaped member 34 having a preferred slant angle of about 20 degrees as measured from the center line of cylindrical member 37. The inner and outer conical shaped members define a space therebetween which is filled with propellant 36. The cylindrical member-37 containing an explosive charge 38 with igniter 39 extends from the smaller base of the conically shaped member. Cylindrical portion 40 is shown extending from the larger bases of inner and outer conically shaped members to thereby extend the spacing defined therebetween to change the preferred 20 degree slant angle of inner and outer conically shaped members to align the defined space perpendicular to the bases of the conical shaped members to thereby discharge from the periphery of the ring of the ring detonator the gases from the explosive composition after ignition. The discharged gases subsequently impinge on the explosive charge of the warhead to achieve improvements and benefits defined hereinbelow.

Figure 5:
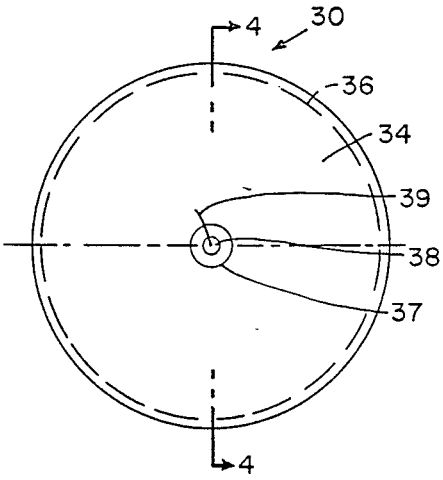
FIG. 5 is a rear view of the ring detonator of the invention.

FIG. 5 shows a rear view of the ring detonator 30 where like numerals are assigned for the elements depicted in FIG. 4.

Figure 6:
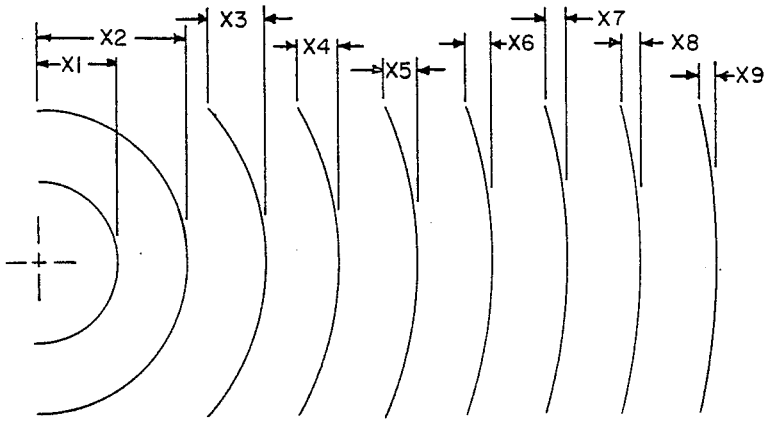
FIG. 6 (PRIOR ART)
FIG. 6 illustrates the formation of a wave front achieved by a point initiator for a four inch diameter warhead by a Prior Art method.

FIG. 6 (Prior Art) depicts a point initiation for a four inch diameter warhead.

Figure 7:
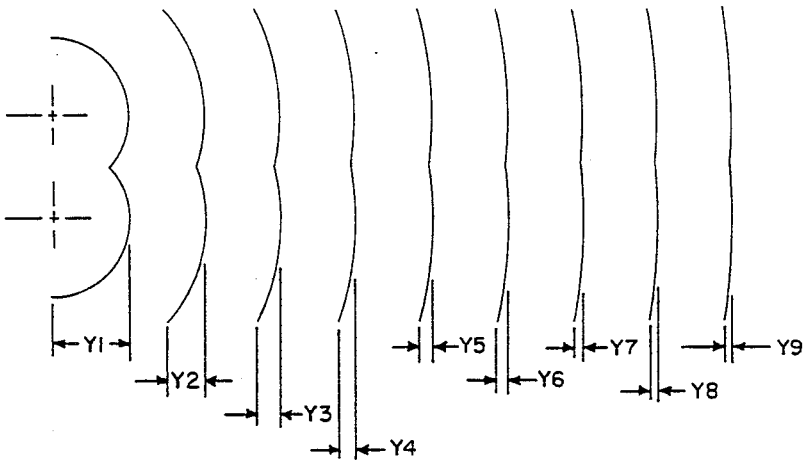
FIG. 7 illustrates the formation of a wave front achieved by the ring detonator of this invention for a four inch diameter warhead.

FIG. 7 depicts the ring initiation for a four inch diameter warhead. Note the flatness of the wave fronts per unit of length as depicted in FIG. 6 wherein X values relate, to point initiation and wherein y values relate to the ring detonator as shown in Table I below.

TABLE I

| Flatness of Wave Fronts of Point versus Ring Initiations After Traveling Inches 1–9 | | |
|---|---|---|
| NO. | X | Y |
| 1 | 1.00 | 1.00 |
| 2 | 2.00 | .509 |
| 3 | .764 | .313 |
| 4 | .536 | .229 |
| 5 | .417 | .181 |
| 6 | .343 | .150 |
| 7 | .292 | .128 |
| 8 | .254 | .112 |
| 9 | .225 | .099 |

Note that the degree of flatness of wave fronts as depicted by X1 and Y1 for point initiation and ring initiation are identical when wave front has moved one inch respectively. At two inches however, the difference is significant; that is, X2 versus Y2 value. Even at nine inches from the initiation points, the ring initiated wave is flatter than the point initiation wave; that is, X9 versus Y9.

Figure 8:
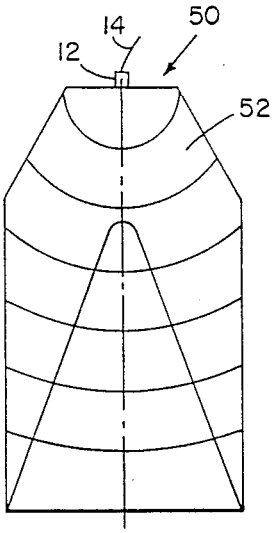
FIG. 8 (PRIOR ART)
FIG. 8 illustrates a conventional warhead design in combination with a point initiation which generates the illustrated shock wave front.
Figure 9:
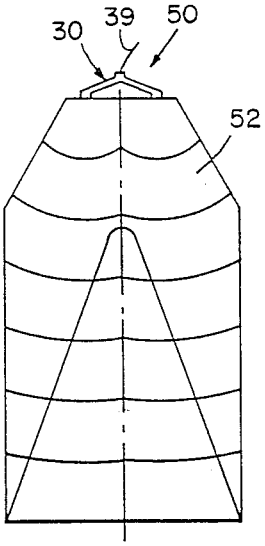
FIG. 9 illustrates the same sized warhead design in combination with the ring detonator of this invention which generates the illustrated flatter shock wave front.
Figure 10:
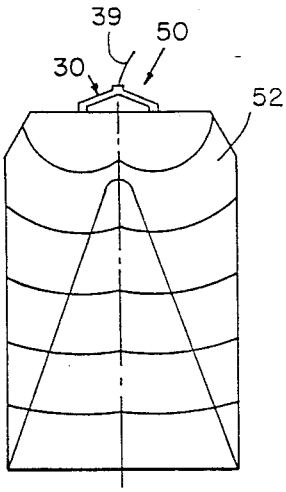
FIG. 10 illustrates a shorter sized warhead design in combination with the ring detonator of this invention which generates the illustrated same flatness as FIG. 8 but compatible with a shorter warhead.

In evaluating the improvement achieved by using the ring detonator of this invention versus the point detonator initiation, FIGS. 8, 9, and 10 illustrate warheads 50 provided with a point detonator 12 with explosive charge 52, ring detonator 30 for the same size warhead explosive charge 52, and ring detonator 30 for shorter warhead explosive charge 52. The ring detonator allows two options for missile warhead designers. The first option is a more optimum charge. The flatter wave front as depicted in FIGS. 9 and 10 contribute to a better warhead performance. The second option is that a shorter explosive charge can be used as depicted in FIG. 10. Length restriction in missiles can be severe so that the advantage of shorter warheads is significant.

The options above are most often considered by missile warhead designers; however, a superior option will now be stated. The design allows for the production of the warhead separate from the waveshaper. This arrangement would simplify production processes using explosives. Alignment of the ring detonator would be easier to accomplish with the external design feature of this invention since alignment could be achieved or measured after production. The designs employing a single detonator require that the initiator be in place during warhead fabrication and alignment must be checked with an X-ray of the warhead. Adjustment is not possible once the warhead is fabricated.

We claim:

1. A ring detonator for a warhead comprising:

(i) an outer conically shaped member having the shape of a modified frustum of a circular cone, said outer conically shaped member having a slant height extending at a predetermined angle and for a predetermined distance to a larger base of said conically shaped member to form the outer ring of said ring detonator that has a diameter of about two thirds the diameter of the warhead with which the ring detonator is employed;

(ii) a cylindrical member extending from the smaller base of said outer conically shaped member which completes the shape to said modified frustum of a circular cone, said cylindrical member having a cavity therein for containing a point detonator charge, said cylindrical member having an opening extending from said cavity through the center line of said smaller base of said outer conically shaped member to an opening provided by mating said outer conically shaped member with an inner conically shaped member;

(iii) an inner conically shaped member mated with said outer modified frustum of a circular cone shaped member in a spaced apart relationship to define a space therebetween for containing an explosive composition, said inner conically shaped member extending at said predetermined angle and for said predetermined distance as defined for said outer conically shaped member to form the inner portion of said ring of said diameter defined hereinabove; and, (iv) a common cylindrically shaped member extending from the larger bases of said outer and inner conically shaped members, said common cylindrically shaped member having an opening extending therethrough to said defined space for containing said explosive composition, said opening permitting the discharge from said formed ring of said ring detonator the detonation shock wave and detonation products from said explosive composition after ignition to thereby effect the transfer of a point detonator charge to said formed ring whereby said ring detonator creates a flatter wave front in a shorter distance to achieve initiation of a warhead by said ring detonator.

2. The ring detonator of claim 1 wherein said predetermined angle of said outer and inner conically shaped members have a preferred slant angle of 20 degrees and wherein said common cylindrically shaped member changes said preferred slant angle of 20 degrees of said inner and outer conically shaped members to achieve alignment of said space perpendicular to the bases of said conically shaped members to thereby discharge from the periphery of the ring detonator the detonation shock wave and detonation products from said explosive composition.

* * * * *